US009431710B2

(12) United States Patent
Huang et al.

(10) Patent No.: US 9,431,710 B2
(45) Date of Patent: Aug. 30, 2016

(54) PRINTED WIDE BAND MONOPOLE ANTENNA MODULE

(71) Applicant: Arcadyan Technology Corporation, Hsinchu (TW)

(72) Inventors: Chih-Yung Huang, Taichung (TW); Kuo-Chang Lo, Miaoli County (TW); Jen-Hsiang Fang, Hsinchu (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 219 days.

(21) Appl. No.: 13/916,124

(22) Filed: Jun. 12, 2013

(65) Prior Publication Data

US 2014/0145885 A1 May 29, 2014

(30) Foreign Application Priority Data

Nov. 26, 2012 (TW) ..... 101144190 A

(51) Int. Cl.
*H01Q 9/04* (2006.01)
*H01Q 1/38* (2006.01)
(Continued)

(52) U.S. Cl.
CPC ..... *H01Q 9/0407* (2013.01); *H01Q 1/38* (2013.01); *H01Q 5/307* (2015.01); *H01Q 5/50* (2015.01); *H01Q 9/40* (2013.01)

(58) Field of Classification Search
CPC ..... H01Q 1/38; H01Q 9/0407; H01Q 5/307; H01Q 5/50; H01Q 9/40
USPC ..... 343/700, 825, 829, 830, 848, 860, 343/700 MS
See application file for complete search history.

(56) References Cited

U.S. PATENT DOCUMENTS 4,369,447 A * 1/1983 Edney ..... H01Q 13/18 343/769
6,198,437 B1 * 3/2001 Watson ..... H01Q 1/38 343/700 MS (Continued)

FOREIGN PATENT DOCUMENTS

TW M260011 U 3/2005
TW M325616 U 1/2008

(Continued)

OTHER PUBLICATIONS

Abbas et al. Aspect Ratio: A Major Controlling Factor of Radiation Characteristics of Microstrip Antenna, Journal of Electromagnetic Analysis and Applications, 2011, 3, p. 452-457.*

(Continued)

*Primary Examiner* — Sue A Purvis
*Assistant Examiner* — Bamidele A Jegede
(74) *Attorney, Agent, or Firm* — Rabin & Berdo, P.C.

(57) ABSTRACT

A printed wide band monopole antenna module is provided. The module comprises: a substrate having a first surface, a ground terminal part formed on the first surface, and an antenna body disposed on the first surface opposite to the ground terminal part. The antenna body comprises: a first extending part having a first length, a second extending part having a second length, and a third extending part having a first width. The width of the second extending part is the first width plus a second width. The second extending part forms a connection with the first and the third extending part. The ratio of the first length to the second length is less than a first value. The ratio of the first length to the sum of the first and the second width is less than a second value.

14 Claims, 4 Drawing Sheets

(51) Int. Cl.

| | |
|---|---|
| ***H01Q 9/40*** | (2006.01) |
| ***H01Q 5/307*** | (2015.01) |
| ***H01Q 5/50*** | (2015.01) |

(56) References Cited

U.S. PATENT DOCUMENTS

| | | | | |
|---|---|---|---|---|
| 6,801,169 | B1 * | 10/2004 | Chang | H01Q 1/22 343/700 MS |
| 6,937,193 | B2 * | 8/2005 | Hendler | H01Q 1/38 343/700 MS |
| 7,242,352 | B2 | 7/2007 | Tavassoli Hozouri | |
| 7,256,743 | B2 | 8/2007 | Korva | |
| 7,773,043 | B1 * | 8/2010 | Horner | H01Q 13/085 343/767 |
| 8,223,076 | B2 * | 7/2012 | Huang | H01Q 1/38 343/700 MS |
| 2004/0196187 | A1 | 10/2004 | Yeh | |
| 2009/0174608 | A1 | 7/2009 | Park et al. | |
| 2011/0025566 | A1 * | 2/2011 | Suh | H01Q 1/2266 343/702 |
| 2011/0032157 | A1 | 2/2011 | Suh et al. | |

FOREIGN PATENT DOCUMENTS

| | | | |
|---|---|---|---|
| TW | I333715 | B | 12/2008 |
| TW | I351787 | A | 8/2009 |
| TW | 201025726 | A | 7/2010 |

OTHER PUBLICATIONS

Behdad et al. A Wide-Band Slot Antenna Design Employing a Fictitious Short Circuit Concept, IEEE Transactions on Antennas and Propagation, vol. 53, No. 1, Jan. 2005.*

Rashidian et al. On the Two Segmented and High Aspect Ratio Rectangular Dielectric Resonator Antennas for Bandwidth Enhancement and Miniaturization, IEEE Transactions on Antennas and Propagation, vol. 57, No. 9, Sep. 2009.*

Choi et al. "Compact Ultra-Wideband Printed Antenna With Band-Rejection Characteristic, Electronics Letters Sep. 1, 2005, vol. 41, No. 18".*

Search Report issued by European Patent Office on Feb. 28, 2014.

Xiaorong Yan, "Compact Ultra-Wideband and Extreme-Wideband Printed Antennas", Shanghai University, May 1, 2008, English abstract.

Taiwanese Office Action dated Feb. 11, 2015.

Chinese Office Action dated Jan. 29, 2016.

* cited by examiner

PRINTED WIDE BAND MONOPOLE ANTENNA MODULE

This application claims the benefit of Taiwan application Serial No. 101144190, filed Nov. 26, 2012, the subject matter of which is incorporated herein by reference.

BACKGROUND OF THE INVENTION

1. Field of the Invention

The invention relates in general to a printed wide band monopole antenna module, and more particularly to an antenna module, which is directly printed on one side of the printed circuit board and used in a portable electronic device and is capable of performing wireless signal transmission and easily adjusting the operating frequency band and bandwidth according to the needs in actual applications.

2. Description of the Related Art

Along with the development in the mobile computation technology, various portable electronic devices such as notebook computer, personal digital assistant, mobile phone and tablet PC are invented and provided. These portable electronic devices have become indispensable to people and brought about tremendous convenience and practicality in their everyday life. Wireless signal transmission such as telephone communication and Internet connection is an important application of the portable electronic devices. Here, wireless signal transmission refers to the reception and transmission of related wireless signals through a built-in and an external antenna by way of radio frequency (RF).

As the portable electronic devices have the features of lightweight, slimness and compactness, related wireless signal transmission modules are also designed and manufactured according to the same features. In terms of the technologies currently available, there are two types of small-sized antennas: chip antenna and planar antenna. The chip antenna includes ceramic chip antenna, while the planar antenna includes micro-strip antenna and printed antenna. Of the planar antennas, the planar inverse-F antenna (PIFA) and the monopole antenna, having the advantages of light structure, excellent transmission efficiency, and simple manufacturing process, can be easily disposed on the inner wall of the device and have been widely used in various portable electronic devices.

To enhance the function and practicality of wireless signal transmission of the portable electronic device, the design of wireless signal transmission module is directed towards multi-band and sufficient bandwidth. For example, to integrate the wireless LAN standards 802.11b and 802.11a in one wireless signal transmission module, the antenna structure or circuit must be capable of operating under two frequencies 2.4 GHz and 5 GHz. The antenna having two operating frequencies is referred as dual-band antenna.

According to the current manufacturing technologies of the planar inverse-F antenna (PIFA), the inner/outer conductive layer of the co-axial cable are respectively soldered on a signal feeding point and a signal ground point of the structure for transmitting the signals. However, to equip the planar inverse-F antenna with the multi-band and the wide band function, the design of the antenna becomes more complicated and the size is increased in most generally known technologies. The complicated and large-sized design will incur higher manufacturing cost and involve more assembly difficulties, and the bandwidth becomes narrower and the frequency band is difficult to adjust under different environments. In contrast, the operation and structure of the monopole antenna are simpler than the PIFA.

Therefore, it is a prominent object of the disclosure to provide a monopole antenna, which uses the same antenna or the same wireless signal transmission module and is capable of effectively performing the multi-band and the wide band function.

SUMMARY OF THE INVENTION

The invention is directed to a printed wide band monopole antenna module. The antenna module is used and built in a portable electronic device capable of performing wireless signal transmission. The antenna body of the antenna module is directly printed on one side of the printed circuit board of the portable electronic device, so that the operating frequency band and bandwidth of the antenna module can be designed and adjusted according to the needs in actual application.

According to an embodiment of the present invention, a printed wide band monopole antenna module is provided. The module comprises: a substrate having a first surface, a ground terminal part formed on the first surface, and an antenna body disposed on the first surface opposite to the ground terminal part. The antenna body further comprises: a first extending part having a first length, a second extending part having a second length, a third extending part having a first width, and a feeding part whose one end is connected between the first extending part and the second extending part and the other end corresponds to the ground terminal part. The width of the second extending part is the first width plus a second width. The second extending part forms a connection with the first extending part and the third extending part. The ratio of the first length to the second length is less than a first value. The ratio of the first length to the sum of the first width and the second width is less than a second value.

According to the printed wide band monopole antenna module of the present invention, the ground terminal part further comprises a back-end area, a front-end area and a middle area, which are mutually connected. The middle area forms a connection with the back-end area and the front-end area, and the two ends of the middle area are respectively connected to the back-end area and the front-end area.

According to the printed wide band monopole antenna module of the present invention, the ground terminal part further comprises a back-end area, a front-end area and a middle area, which are mutually connected. The back-end area is formed on one side of the third extending part and separated from the second extending part by a first interval. The front-end area is formed on one side of the first extending part and separated from the first extending part by a second interval. The middle area is respectively separated from the first extending part and the second extending part by a third interval. The first interval is larger than the second interval, the second interval is larger than or equal to the third interval, and the impedance matching of the antenna body can be achieved by adjusting the size of the first interval, the second interval and/or the third interval.

According to the printed wide band monopole antenna module of the present invention, the substrate further comprises a second surface. The second surface and the first surface are respectively disposed on two opposite sides of the substrate. The projection of the antenna body is mapped to a hollowed area on the second surface and no metal structure is disposed in the hollowed area.

The above and other aspects of the invention will become better understood with regard to the following detailed description of the preferred but non-limiting embodiment(s). The following description is made with reference to the accompanying drawings.

BRIEF DESCRIPTION OF THE DRAWINGS

FIG. 1(*b*) shows a 3D diagram of the printed wide band monopole antenna module 100 at an angle;

DETAILED DESCRIPTION OF THE INVENTION

Figure 1:
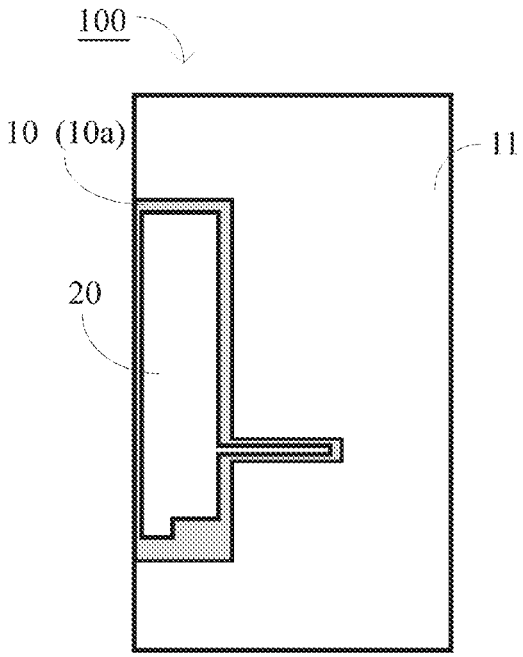
FIG. 1(*a*) shows a planar diagram of a printed wide band monopole antenna module 100.
Figure 1:
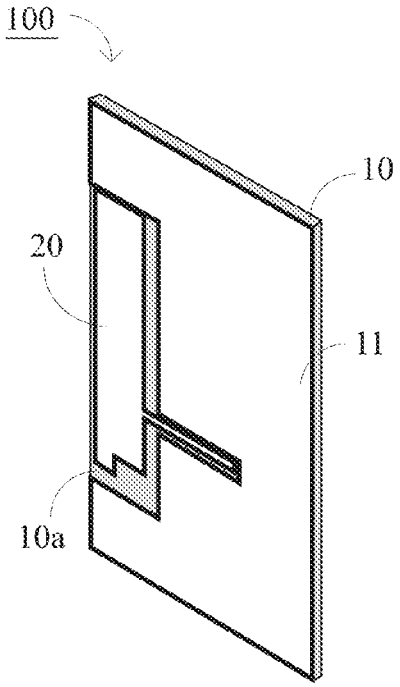

The implementation of the present invention is firstly exemplified by a first embodiment disclosed below. Referring to both FIGS. 1(*a*) and (*b*). FIG. 1(*a*) shows a planar diagram of a printed wide band monopole antenna module 100. FIG. 1(*b*) shows a 3D diagram of the printed wide band monopole antenna module 100 at an angle. As indicated in FIGS. 1(*a*) and (*b*), the printed wide band monopole antenna module 100 mainly comprises a substrate 10, a ground terminal part 11 and an antenna body 20. The substrate 10 is a dielectric printed circuit board having two surfaces. Only a first surface 10*a* of the two surfaces is illustrated in the diagram, and the ground terminal part 11 is formed on the first surface 10*a*.

The antenna body 20 is printed by way of micro-strips and disposed on the first surface 10*a* opposite to the ground terminal part 11. In the present embodiment, the ground terminal part 11 formed on the first surface 10*a* can be a printed metal surface, and no structure is formed on the other surface (that is, a second surface) of the substrate 10, such that the printed wide band monopole antenna module 100 forms a dual-layer structure. The second surface and the first surface are respectively disposed on two opposite sides of the substrate and are not illustrated in the diagram. In other implementations, another ground metal surface can be formed on the other surface of the substrate 10, such that the entire module forms a tri-layer structure. It should be noted that the tri-layer structure (or more layers) enables the antenna to radiate, and the area on the other surface corresponding to the antenna body 20 must be hollowed. That is, the projection of the antenna body 20 is mapped to a hollowed area on the second surface and no metal structure is disposed in the hollowed area.

On the other hand, the printed wide band monopole antenna module 100 of the present invention is used and built in a portable electronic device capable of performing wireless signal transmission. As the design of portable electronic device is directed towards lightweight, slimness and compactness, the size of the substrate 10 forming the circuit board must correspond to the size of the portable electronic device. That is, the entire antenna module and other components of the electronic device can be disposed on the same board. In addition, the antenna module and other components of the portable electronic device can be independently disposed. That is, the substrate 10 on which the antenna is disposed can be realized as another smaller printed circuit board independently hanged or adhered on a predetermined part of the electronic device (such as the inner wall of the casing of the electronic device).

Figure 2:
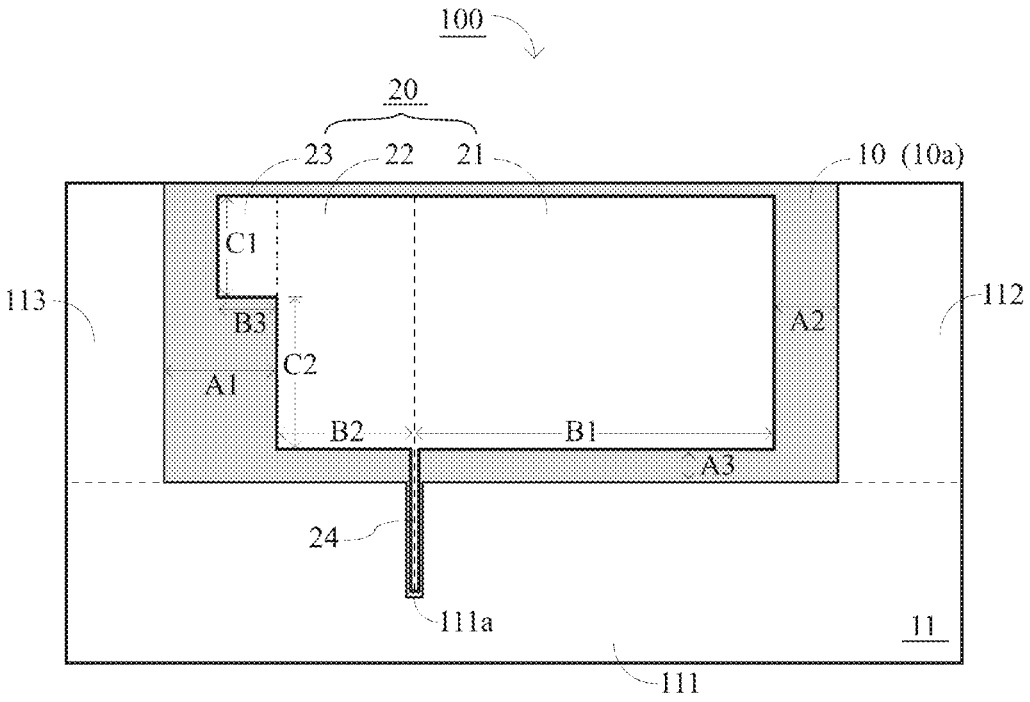
FIG. 2 shows an enlargement diagram of a planar diagram of the printed wide band monopole antenna module 100.

Referring to FIG. 2, an enlarged diagram of a planar diagram of the printed wide band monopole antenna module 100 is shown. As indicated in the diagram, the antenna body 20 comprises a first extending part 21, a second extending part 22, a third extending part 23 and a feeding part 24. The second extending part 22 forms a connection with the first extending part 21 and the third extending part 23, and two sides of the second extending part 22 are respectively connected to the first extending part 21 and the third extending part 23. It can be known from the characteristics of an ordinary monopole antenna that signals are fed to the monopole antenna through one terminal point only, and the signal feeding point and the ground point are mutually independent. One end of the feeding part 24 is connected to a position between the first extending part 21 and the second extending part 22, and the other end of the feeding part 24 is corresponding to the ground terminal part 11.

As indicated in FIG. 2, the first extending part 21 has a first length B1, and the second extending part 22 has a second length B2. In the present embodiment, the first extending part 21 and the second extending part 22 both have a width (=C1+C2) equal to a first width C1 plus a second width C2. That is, the first extending part 21 and the second extending part 22 both have a rectangular shape. Next, the third extending part 23 has the first width C1 and a third length B3; and the third extending part 23 and the second extending part 22 are connected as a stepped shape, such that more current patterns can be generated to perform corresponding impedance matching and achieve the required frequency band.

In the present embodiment, the first extending part 21 is a radiation body used for the purpose of signal transmission. In greater details, the first length B1 of the first extending part 21 is designed for determining a working frequency of the antenna. That is, the length extended from the feeding point of the feeding part 24 towards the terminal edge of the first extending part 21 is relevant to the magnitude of the resonant frequency. Basically, the length is approximately equal to a quarter of the resonant wavelength of the working frequency of the designed frequency band. On the other hand, the second extending part 22 and the third extending part 23 are used for adjusting impedance matching. That is, the shape (that is, a stepped shape) extended from the feeding point of the feeding part 24 towards the terminal edges of the second extending part 22 and the third extending part 23 can make the voltage standing wave ratio (VSWR) of the antenna achieve the required condition. Besides, the width (=C1+C2) determines the available bandwidth of the antenna body 20.

Furthermore, the design of the antenna body 20 has the following conditions: Firstly, the first length B1 is larger than the second length B2, and the ratio of the first length B1 to the second length B2 is less than a first value. In the present embodiment, the first value is 4. That is:

$$\frac{B1}{B2} < 4 \quad (1)$$

Secondly, the second width C2 is larger than the first width C1, and the ratio of the first length B1 to the sum of the first width C1 and the second width C2 is less than a second value. In the present embodiment, the second value is 2.5. That is:

$$\frac{B1}{C1+C2} < 2.5 \quad (2)$$

As indicated in FIG. 2, the ground terminal part 11 comprises a back-end area 113, a front-end area 112 and a middle area 111. The middle area 111 forms a connection with the back-end area 113 and the front-end area 112. Two ends of the middle area 111 are respectively connected to the back-end area 113 and the front-end area 112. It can be known from the above disclosure that signals are fed to the monopole antenna through one terminal point only, and the signal feeding point and the ground point are mutually independent. In the present embodiment, the other end of the feeding part 24 is adjacent to the ground terminal part 11, that is, the other end of the feeding part 24 is corresponding to a signal feeding ground point 111*a* of the middle area 111 of the ground terminal part 11.

To be more specific, the feeding part 24 is formed by using a 50 Ohm (Ω) circuit and directly disposed on the substrate 10. One end of the Ohm circuit is soldered to a feeding point at the junction between the first extending part 21 and the second extending part 22 for feeding signals, and the other end of the Ohm circuit can be correspondingly extended towards the signal feeding ground point 111*a*.

Referring to FIG. 2. The back-end area 113 is formed on one side of the third extending part 23, and is separated from the second extending part 22 by a first interval A1. Next, the front-end area 112 is formed on one side of the first extending part 21, and is separated from the first extending part 21 by a second interval A2. Besides, the middle area 111 is separated from the first extending part 21 and the second extending part 22 respectively by a third interval A3. After signals are fed in, currents will flow through the vicinity of the ground terminal part 11. Therefore, the areas 111, 112 and 113 are all used for adjusting impedance matching. In the present embodiment, the back-end area 113 and the front-end area 112 both have a rectangular shape, the first interval A1 is larger than the second interval A2, and the second interval A2 is larger than or equal to the third interval A3. Furthermore, the impedance matching of the antenna body 20 can be adjusted by adjusting the size of the first interval A1, the second interval A2 and/or the third interval A3.

Figure 3:
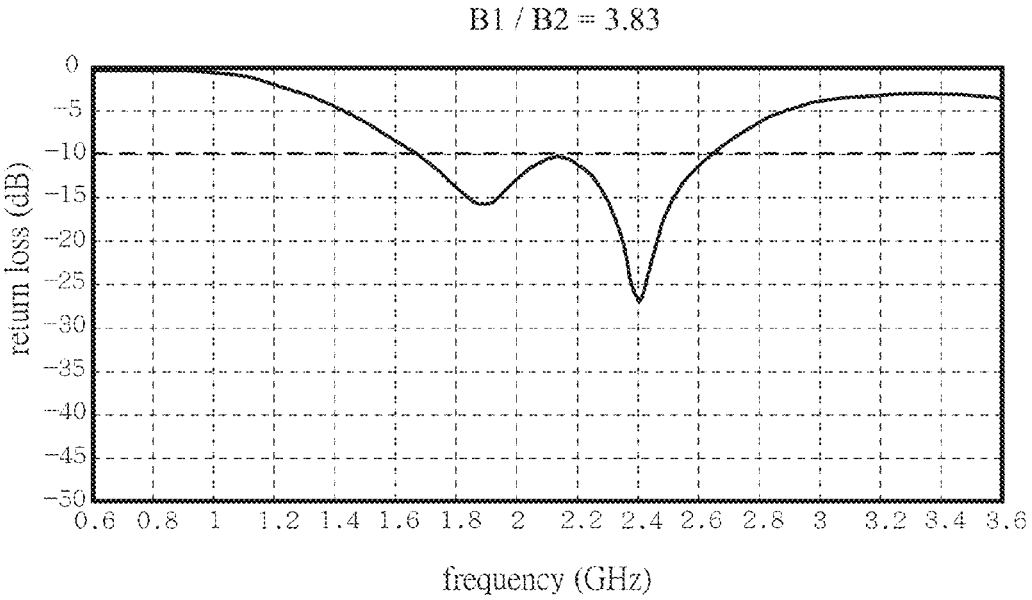
FIG. 3 shows a diagram of testing results of return loss (dB) vs. frequency (GHz) of the printed wide band monopole antenna module 100 according to a first embodiment.

Referring to FIG. 3, a diagram of testing results of return loss (dB) vs. frequency (GHz) of the printed wide band monopole antenna module 100 according to a first embodiment is shown. The curve in the diagram represents the testing results obtained when the value of the ratio B1/B2 is equal to 3.83. When the test is based on the return loss (dB), the testing standard is set as −10 dB in the present embodiment. In greater details, those frequencies corresponding to the part of the curve below −10 dB can be effectively used, and those frequencies corresponding to the part of the curve over −10 dB cannot be effectively used due to large return loss on the transmission interface. In the present embodiment, the ratio of the first length B1 to the second length B2 is less than 4 (formula 1). In terms of the testing results obtained when the value of the ratio B1/B2 is equal to 3.83 as indicated in FIG. 3, the available frequency band corresponding to the part of the curve below −10 dB is between 1.7~2.7 GHz. That is, the available bandwidth is about 1.0 GHz (or 1000 MHz), and 1.7 GHz is the working frequency corresponding to the first length B1.

Figure 4:
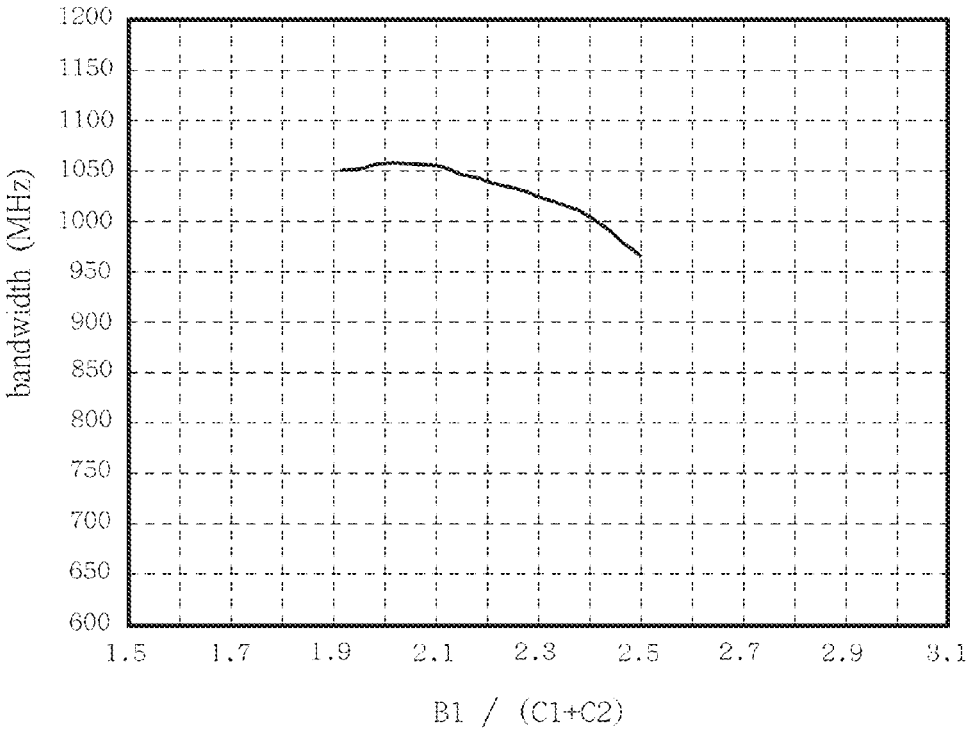
FIG. 4 shows a diagram of testing results of bandwidth (MHz) of the printed wide band monopole antenna module 100 vs. ratio (B1/(C1+C2)) according to a first embodiment.

Referring to both FIG. 4, a diagram of testing results of bandwidth (MHz) of the printed wide band monopole antenna module 100 vs. ratio (B1/(C1+C2)) according to a first embodiment is shown. The first length B1 of the first extending part 21 is designed for determining the working frequency of the antenna. The bandwidth of the antenna can be determined by fixing the first length B1 and adjusting the sum (=C1+C2) of the widths of the first extending part 21 and the second extending part 22. In the present embodiment, the ratio of the first length B1 to the sum of the first width C1 and the second width C2 is less than 2.5 (formula 2). In terms of the testing results obtained when the value of the ratio B1/(C1+C2) is between 1.9~2.5 as indicated in FIG. 4, the available bandwidth is between 970~1060 MHz. That is, in average, the available bandwidth is about 1000 MHz.

Based on the relevant design conditions of the printed wide band monopole antenna module 100 in the present embodiment, the printed wide band monopole antenna module 100 can be implemented and used in the portable electronic device for wireless signal transmission with the operating frequency bands such as Band 1 (1920~2170 MHz), Band 3 (1710~1880 MHz), Band 4 (1710~2155 MHz), Band 7 (2500~2690 MHz), Band 38 (2570~2620 MHz), and Band 40 (2300~2400 MHz) of the long term evolution (LTE) technology, the UMTS (1920~2170 MHz), and the WiFi 802.11bg (2.40~2.50 GHz). Or, the printed wide band monopole antenna module 100 can be implemented and used in any systems applicable to the frequency band 1710~2700 MHz of the LTE technology. Or, with the frequency band of the printed wide band monopole antenna module 100 being slightly adjusted, the printed wide band monopole antenna module 100 can also be implemented and used in other wireless signal transmission systems or devices operating under other frequency bands.

Based on the concepts disposed in the first embodiment, variations and modifications can further be made to the present invention to achieve similar effects and objects with similar structural design. The implementation of the present invention is further exemplified by a second embodiment disclosed below. In the second embodiment, a printed wide band monopole antenna module 102 is provided.

Figure 5:
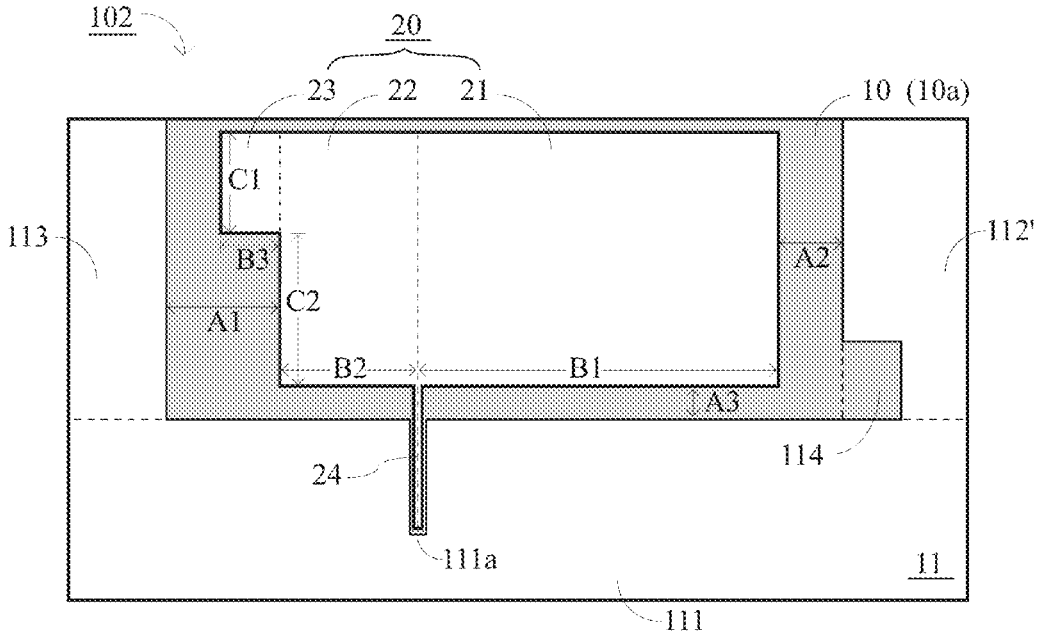
FIG. 5 shows an enlargement diagram of a planar diagram of a printed wide band monopole antenna module 102.

Referring to FIG. 5, an enlargement of a planar diagram of the printed wide band monopole antenna module 102 is shown. The components common to the first embodiment and the second embodiment retain the same numeric designation. As indicated in FIG. 5, the second embodiment is different from the first embodiment in that the ground terminal part 11 of the second embodiment further comprises a slot 114 formed between the front-end area 112' and the middle area 111. Likewise, after signals are fed in, currents will flow through the vicinity of the ground terminal part 11. Therefore, impedance matching will be adjusted in the areas 111, 112' and 113. In the second embodiment, the front-end area 112' has a stepped shape in response to the design of the slot 114, such that more current patterns can be generated on the stepped front-end area 112' and corresponding impedance matching can be adjusted.

The implementation of the present invention is further exemplified by a third embodiment disclosed below. In the third embodiment, a printed wide band monopole antenna module 103 is provided.

Figure 6:
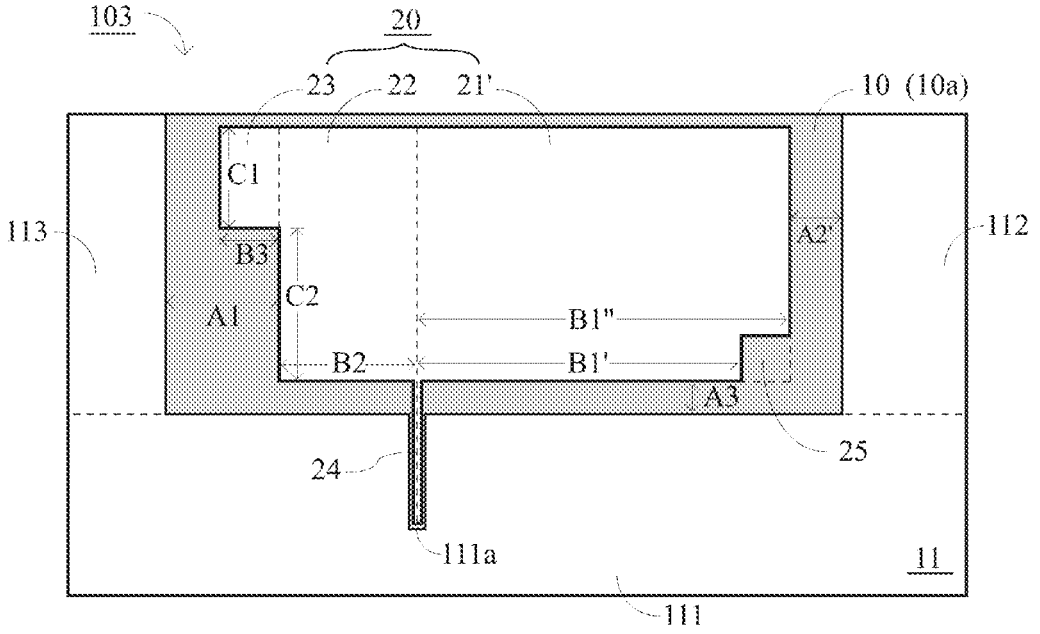
FIG. 6 shows an enlargement diagram of a planar diagram of a printed wide band monopole antenna module 103.

Referring to FIG. 6, an enlargement of a planar diagram of the printed wide band monopole antenna module 103 is shown. The components common to the first embodiment and the third embodiment retain the same numeric designation. As indicated in FIG. 6, the third embodiment is different from the first embodiment in that the antenna body 20 of the third embodiment further comprises a missing block 25 formed at a corner of the first extending part 21', such that the first extending part 21' has a stepped shape on the side opposite to the front-end area 112. In the third embodiment, in response to the design of the missing block 25, the first length of the first extending part 21' changes to B1" from B1'. In comparison to the first embodiment, length B1' is less than length B1 (but is larger than length B2), and the length B1" is larger than the length B1. That is, the first extending part 21' is extended towards the front-end area 112, such that the interval A2' is less than the interval A2.

When the values of the first lengths B1' and B1" of the first extending part 21' are brought to the value of the first length B1 of the first embodiment in formula 1 and formula 2, the values of the first lengths B1' and B1" of the first extending part 21' must satisfy the conditions of formula 1 and formula 2. The length of the first extending part 21' is designed for determining the working frequency of the antenna. Therefore, when the first lengths B1' and B1" vary, the working frequency determined by the first lengths B1' and B1" will vary accordingly, and different frequency bands can be obtained by adjusting the working frequency.

The printed wide band monopole antenna module of the present invention at least has the following features or effects:

Firstly, the printed wide band monopole antenna module of the present invention is based on the principles of monopole antenna and does not require any ground points as required in the planar inverse-F antenna (PIFA), and therefore has a size smaller than the PIFA. Meanwhile, the feeding part of the printed wide band monopole antenna module of the present invention is directly printed on the printed circuit board, hence saving the cost of using the co-axial cable for feeding signals.

Secondly, the antenna body of the present invention can be directly printed on one side of the printed circuit board, that is, the operating frequency band and bandwidth can be easily adjusted according to the needs in actual applications with the design change in related lengths and widths. Meanwhile, the antenna module of the present invention requires lower mold cost and assembly cost than ordinary 3D antenna.

Thirdly, the testing results show that the antennal module of the present invention can be effectively used in the LTE frequency band 1710~2700 MHz, or with the frequency band being slightly adjusted, the antennal module of the present invention can further be used in other systems or devices operating under other frequency bands. Meanwhile, the entire antenna module can be realized as a single board or a smaller circuit board disposed independently and used in electronic devices.

Therefore, the present invention can effectively resolve related problems encountered in the prior art and successfully achieve the key objects of the disclosure.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A printed wide band monopole antenna module, comprising:

a substrate having a first surface;

a ground terminal part formed on the first surface; and an antenna body disposed on the first surface opposite to the ground terminal part, wherein the antenna body further comprises:

a first extending part having a first length;

a second extending part having a second length, wherein a width of the second extending part is equal to a positive first width value plus a positive second width value;

a third extending part having a width equal to the first width value so that the width of the third extending part is smaller than the width of the second extending part, wherein the second extending part forms a connection between the first extending part and the third extending part; and a feeding part whose one end is connected to a position between the first extending part and the second extending part and the other end is corresponding to the ground terminal part, wherein a width of the first extending part is equal to the width of the second extending part, wherein the ground terminal part comprises:

a back-end area formed on one side of the third extending part and separated from the second extending part by a first interval;

a front-end area formed on one side of the first extending part and separated from the first extending part by a second interval;

a middle area forms a connection with the back-end area and the front-end area and respectively separated from the first extending part and the second extending part by a third interval, wherein the first interval is larger than the second interval, and the second interval is larger than or equal to the third interval; and a slot formed between the front-end area and the middle area to separate a distance larger than the second interval from the first extending part so as to form a step-shape ground terminal part, wherein the first length of the first extending part is in part determinative of a working frequency of the antenna body, and the width of the second extending part is in part determinative of a frequency bandwidth of the antenna body, wherein the second interval, the third interval and the slot achieve impedance matching of the antenna body at two resonant frequencies of the antenna body between 1.7 and 2.7 GHz.

2. The printed wide band monopole antenna module according to claim 1, wherein the substrate is a dielectric printed circuit board.

3. The printed wide band monopole antenna module according to claim 1, wherein the ground terminal part is a printed metal surface.

4. The printed wide band monopole antenna module according to claim 1, wherein the first length determines a working frequency, and the first length is larger than the second length.

5. The printed wide band monopole antenna module according to claim 1, wherein the second width is larger than the first width.

6. The printed wide band monopole antenna module according to claim 1, wherein the second extending part and the third extending part are used for adjusting impedance matching.

7. The printed wide band monopole antenna module according to claim 1, wherein the width of the first extending part is the first width plus the second width.

8. The printed wide band monopole antenna module according to claim 1, wherein the substrate further comprises a second surface, the second surface and the first surface are respectively disposed on two opposite sides of the substrate, the projection of the antenna body is mapped to a hollowed area on the second surface and no metal structure is disposed in the hollowed area.

9. The printed wide band monopole antenna module according to claim 1, wherein the ratio of the first length to the second length is less than a first value, and the first value is 4.

10. The printed wide band monopole antenna module according to claim 1, wherein the ratio of the first length to the sum of the first width and the second width is less than a second value, and the second value is 2.5.

11. The printed wide band monopole antenna module according to claim 1, wherein the antenna body comprises a missing block formed at a corner of the first extending part.

12. The printed wide band monopole antenna module according to claim 1, wherein one of the two resonant frequencies is between 1.8 GHz and 2.0 GHz, and the other of the two resonant frequencies is at 2.4 GHz.

13. The printed wide band monopole antenna module according to claim 12, wherein the ratio of the first length to the second length is less than 4, whereby the working frequency corresponding to the first length is at 1.7 GHz.

14. The printed wide band monopole antenna module according to claim 12, wherein the ratio of the first length to the sum of the first width and the second width is less than 2.5, whereby the frequency bandwidth of the antenna body below −10 dB is between 970 and 1000 MHz.

* * * * *